US006330945B1

(12) United States Patent
Reimer

(10) Patent No.: US 6,330,945 B1
(45) Date of Patent: Dec. 18, 2001

(54) CLAMSHELL PACKAGE WITH CURVED CARD

(75) Inventor: Joe Reimer, Oregon, WI (US)

(73) Assignee: Placon Corporation, Madison, WI (US)

( * ) Notice: Subject to any disclaimer, the term of this patent is extended or adjusted under 35 U.S.C. 154(b) by 0 days.

(21) Appl. No.: 09/607,765

(22) Filed: Jun. 30, 2000

(51) Int. Cl.[7] ..... B65D 73/00
(52) U.S. Cl. ..... 206/470; 206/471; 206/461
(58) Field of Search ..... 206/461, 462, 206/467, 470, 471; 220/4.23, 836

(56) References Cited

U.S. PATENT DOCUMENTS

| | | | | |
|---|---|---|---|---|
| 2,893,546 | | 7/1959 | Kendall et al. . | |
| 3,298,506 | | 1/1967 | Reiner et al. . | |
| 3,400,811 | | 9/1968 | Panicci . | |
| 4,173,655 | | 11/1979 | Capo . | |
| 4,669,610 | | 6/1987 | Lindsey et al. . | |
| 4,930,627 | | 6/1990 | Borst et al. . | |
| 4,958,735 | | 9/1990 | Odabashian . | |
| 5,143,215 | | 9/1992 | Hartley et al. . | |
| 5,353,935 | * | 10/1994 | Yeager et al. | 206/470 |
| 5,819,939 | * | 10/1998 | Boyer | 206/461 |
| 5,875,893 | | 3/1999 | Lee et al. . | |
| 5,988,429 | * | 11/1999 | Coe | 221/25 |
| 6,065,589 | * | 5/2000 | Ouwens | 206/6.1 |
| 6,170,663 | * | 1/2001 | Glassman | 206/461 |

* cited by examiner

*Primary Examiner*—David T. Fidei
(74) *Attorney, Agent, or Firm*—Lathrop & Clark LLP

(57) ABSTRACT

A hanging clamshell package has a thermoformed plastic blister with a cover pivotally connected by a hinge to a base. The cover has a curved rearwardly opening front wall. A product bubble protrudes frontwardly from the cover front wall and has a curved front face. A bubble top wall extends between the cover front wall and the bubble front face, and beneath the bubble top wall, a bubble bottom wall extends between the cover front wall and the bubble front face, the forward extension of the bubble top wall is less than the forward extension of the bubble bottom wall, tending to counteract the visual impact of product settling. The base has a curved rearwardly opening base front wall of approximately the same curvature as the cover front wall. A card is clasped between the cover front wall and the base front and is thereby conformed to a curvature approximately matching that of the cover front wall. When a peg is inserted though a package hang hole above the product bubble, the low center of gravity of the loaded package causes it to pivot rearwardly, bringing the curved front wall of the cover to a more nearly vertical orientation.

3 Claims, 3 Drawing Sheets

CLAMSHELL PACKAGE WITH CURVED CARD

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

None.

BACKGROUND OF THE INVENTION

The present invention relates to packages in general, and to thermoformed plastic clamshell packages in particular.

Packages intended for the retail display of merchandise must meet several demanding requirements: they should be easily loaded with product, readily mounted for display, and attractive in appearance. In addition, it is desirable that the customer be able to see the product directly.

The clamshell package has long provided a satisfactory solution to these needs. Typically thermoformed from a thin sheet of transparent thermoplastic material, the conventional clamshell package has a cover with a frontwardly protruding product bubble which receives the merchandise, and a base which is pivotally connected to the base by a molded hinge. Because the base is permanently connected to the cover, all the elements needed to close the package remain connected from the time of manufacture of the blister to the final closure of the package after product loading. Often a printed card is enclosed between the cover and the base to provide descriptive and identifying information about the product contents. The base may be sealed to the cover by heat sealing, adhesive, or ultrasonic sealing, or, if ready opening of the package is required, the base may be releasably secured in the closed position on the cover by interengaging tabs and detents.

However, distinctive and eye-catching packages can help to make a particular product stand out from other goods. Furthermore, volume for display of goods is in short reply, giving an advantage to products which can be compactly displayed. What is needed is an attractive clam shell package which is economically loaded with product, and which effectively makes use of retail volume to maximize consumer attention.

SUMMARY OF THE INVENTION

The hanging clamshell package of this invention has a thermoformed plastic blister with a cover pivotally connected by a hinge to a base. The cover has a curved rearwardly opening front wall. A product bubble protrudes frontwardly from the cover front wall and has a curved front face. A bubble top wall extends between the cover front wall and the bubble front face, and beneath the bubble top wall, a bubble bottom wall extends between the cover front wall and the bubble front face. The forward extension of the bubble top wall is less than the forward extension of the bubble bottom wall, tending to counteract the visual impact of product settling. The base has a curved rearwardly opening base front wall of approximately the same curvature as the cover front wall. A card is clasped between the cover front wall and the base front wall and is thereby conformed to a curvature approximately matching that of the cover front wall. When a peg is inserted though a package hang hole above the product bubble, the low center of gravity of the loaded package causes it to pivot rearwardly, bringing the curved front wall of the cover to a more nearly vertical orientation.

The curved cover front wall has a hang hole opening in its uppermost regions, and a loading surface is defined between the hang hole and the product bubble. This inclined loading surface facilitates the introduction of product into the bubble during loading, reducing the level of accuracy required for product positioning during loading.

It is an object of the present invention to provide a hanging package which presents maximum visual display surface for a given size.

It is another object of the present invention to provide a hanging package which presents a more nearly upright display surface when the package is tilted frontwardly due to the loading of the package.

It is a further object of the present invention to provide a hanging package which causes an enclosed card to take on a curved shape.

It is an additional object of the present invention to provide a method for loading a clam shell package with product which requires less accurate positioning of the product as it is introduced into the package.

Further objects, features and advantages of the invention will be apparent from the following detailed description when taken in conjunction with the accompanying drawings.

DESCRIPTION OF THE PREFERRED EMBODIMENTS

Figure 1:
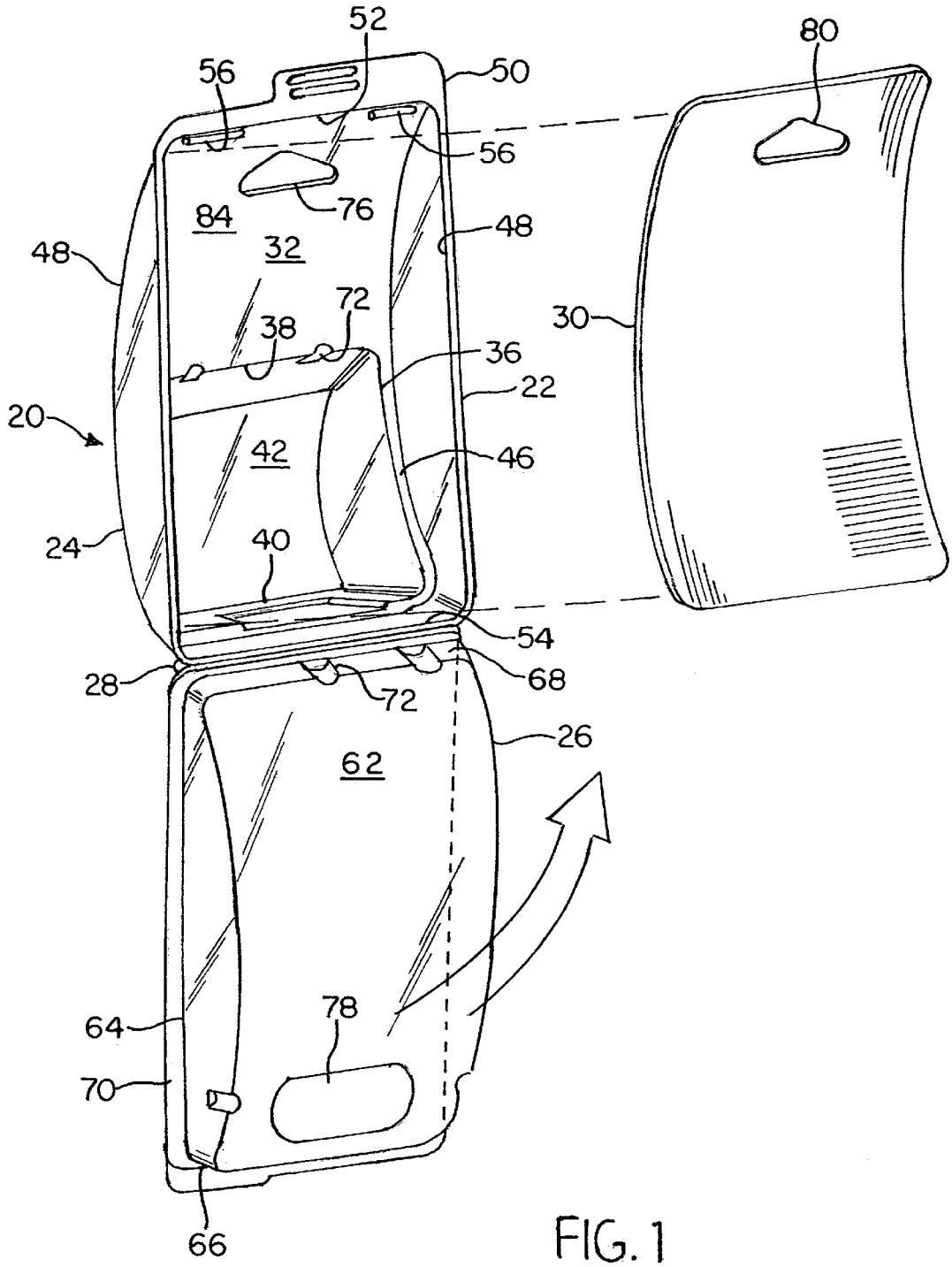
FIG. 1 is an exploded isometric view of the package of this invention.
Figure 2:
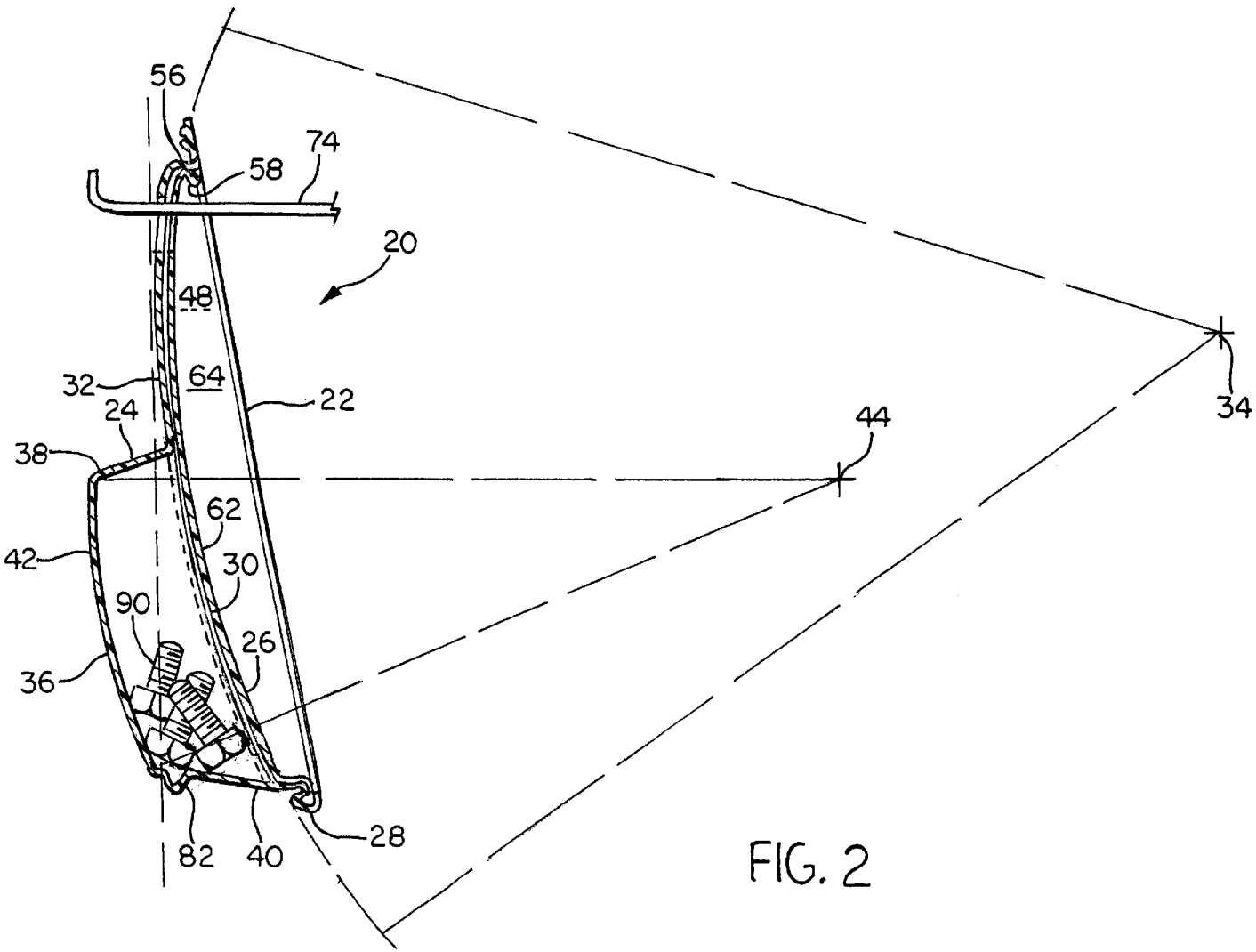
FIG. 2 is a cross-sectional view of the package of FIG. 1 shown in a hanging configuration on a display peg.
Figure 3:
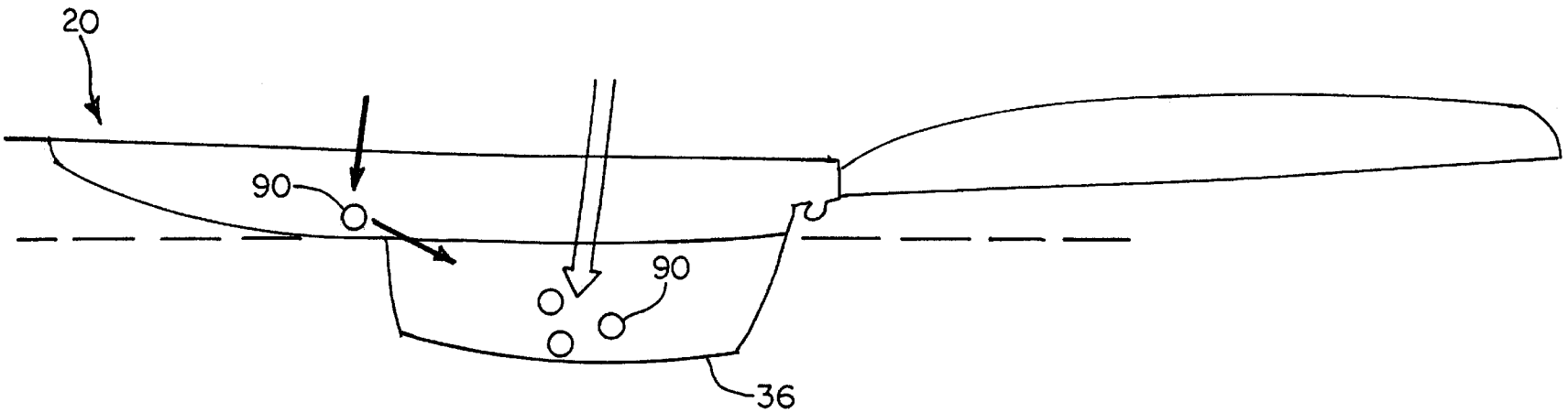
FIG. 3 is a schematic view of the loading of the package of FIG. 1 with product.

Referring more particularly to FIGS. 1–3, wherein like numbers refer to similar parts, a clamshell package 20 of this invention is shown in FIG. 1. The package 20 has a blister 22 which is preferably formed from a thin sheet of transparent thermoplastic material in the single sheet thermoforming process. The container may be formed of RPET, PET, HIPS, high density polyethylene, polyurethane, or other suitable plastic material. The thermoformed sheet material will generally be from about 0.007 inches thick to 0.07 inches thick.

The blister 22 has a cover 24 which is connected to a base 26 along an integrally formed hinge 28 along the lower edge of the cover. A display card 30 is clasped between the cover 24 and the base 26 and has indicia thereon of an informative or identifying nature which it is desired to present to the customer.

As best shown in FIG. 2, the cover 24 has a rearwardly opening front wall 32 which is curved to define portions of a cylinder. The cylindrical surface defined by the front wall 32 is defined with respect to a horizontal cylindrical axis 34 which is to the rear of the package 20. A product bubble 36 protrudes frontwardly from the cover front wall 32. The product bubble has a frontwardly extending top wall 38 positioned above a frontwardly extending bottom wall 40. The top wall 38 is connected to the bottom wall 40 by a bubble front face 42 which is also curved. The forward extension, with respect to the front wall 32, of the top wall 38 is less than the forward extension of the bottom wall 40, with the result that the product bubble 36 tapers as it extends upwardly. The curvature of the bubble front face 42 is such as to define a portion of a cylinder defined about an axis 44 which is forward of and below the axis 34. As shown in FIG. 1, the width of the product bubble 36 is less than the width of the front wall 32, such that a narrow ledge 46 is defined between the product bubble and the side skirts 48 which extend rearwardly from the front wall. Because the card will be clamped against the ledges 46, there is no need to seal the card to the cover, allowing the product bubble size to be maximized. The side skirts 48 extend rearwardly to a peripheral flange 50 which encircles the cover 24. The flange 50 extends in substantially a single plane. A top skirt 52 and a bottom skirt 54 connect the side skirts 48. As shown in FIG. 1, the top skirt may be provided with one or more detents 56 which engage with mating recesses 58 on the base 26, as shown in FIG. 2, to hold the package in a closed configuration.

The base 26 has a curved front wall 62 which mates with the cover front wall 32 when closed on the cover 24, and is thus of approximately the same curvature as the cover front wall. The base 26 has side skirts 64, and a top skirt 66 and a bottom skirt 68 which overlie the corresponding parts of the cover when closed. A flange 70 extends at the rear of the base skirts 64, 66, 68 and is coplanar with the cover flange 50 when closed. The base 26 and the product bubble 36, as shown in FIG. 1, may be provided with one or more stiffening fillets 72 to support the desired shape.

Typically, the package 20 will be displayed in a retail environment by being suspended from a frontwardly extending rod or peg 74, as shown in FIG. 2. To facilitate this mode of support, the cover 24 has a triangular hang hole 76 which is positioned immediately below the top skirt 52. A somewhat larger oblong hang hole 78 is formed on the front wall 62 of the base 26, and a corresponding triangular hang hole 80 is die cut in the card 30.

The curved structure of the package cover front wall and base front wall has several beneficial effects: First, because the display area of the card is curved, there is greater display surface area for a given vertical height. Second, as shown in FIG. 2, the loading of the product blister will tend to cause the package, when hanging on a peg, to pivot rearwardly; however, the curve of the card results in the display area of the card, when hanging, being more nearly vertical.

Likewise, the blister may be provided with a foot 82 to hold it at a similar forwardly inclined orientation when it is set on a horizontal surface, and in which orientation the curvature of the card is more readily viewable. The upwardly tapering product bubble also has the advantageous property of lessening the tendency of settled product to present an appearance of incomplete fill. The tapered bubble has the appearance of being more full to a potential customer.

The package 20 also presents advantages in the process of filling the product bubble with product. As shown in FIG. 3, when ready to be filled, the blister 22 is laid out horizontally, with the base 26 opened and pivoted about the hinge 28. The blister is preferably oriented so that the horizontal plane extends tangent to the top and bottom edges of the product bubble 36. The cover front wall has portions between the hang hole 76 and the bubble top wall 38 which define a product loading chute 84. The chute 84, which is inclined downwardly to the product bubble 36, aids the flow of product 90 into the product bubble 36. When the articles loaded in the package 20 are multiple small items such as screws, tacks, nuts, bolts, or the like, the chute 84 provides a margin of error for the machine which is loading the package 20. If there is a slight overshoot of the bubble, the overshot product can be carried along the chute 84 into the bubble 36.

It is understood that the invention is not limited to the particular construction and arrangement of parts herein illustrated and described, but embraces such modified forms thereof as come within the scope of the following claims.

What is claimed is:

1. A package comprising:

a thermoformed plastic blister having a cover pivotally connected by a hinge to a base, wherein the cover has a curved rearwardly opening front wall, and wherein a cover skirt extends rearwardly from the cover front wall, and wherein a product bubble protrudes frontwardly from the cover front wall, the product bubble having a front face, and a bubble top wall extends between the cover front wall and the bubble front face, and beneath the bubble top wall, a bubble bottom wall extends between the cover front wall and the bubble front face, the forward extension of the bubble top wall being less than the forward extension of the bubble bottom wall, and wherein the base has a curved rearwardly opening base front wall of approximately the same curvature as the cover front wall; and a card clasped between the cover front wall and the base front wall when the base is pivoted about the hinge to close the package, the card being conformed to a curvature approximately matching that of the cover front wall by being clasped between the curved cover front wall and the curved base front wall.

2. The package of claim 1 wherein the bubble front face is curved between the bubble top wall and the bubble bottom wall.

3. A thermoformed thermoplastic blister for assembly into a package with a card, the blister comprising:

a cover having a curved rearwardly opening front wall, the cover front wall defining portions of a cylinder defined with respect to a first axis which extends horizontally, and which is positioned rearwardly of the cover, wherein a product bubble protrudes frontwardly from the cover front wall, the product bubble having a front face, the front facing defining portions of a cylinder defined with respect to a second axis which extends parallel to the first axis, and which is positioned rearwardly of the cover, the second axis being positioned below the first axis, such that a bubble is defined which protrudes frontwardly with respect to the front face a greater amount as it extends downwardly; and a base which is connected to the cover along a hinge, wherein the base has a curved rearwardly opening base front wall of approximately the same curvature as the cover front wall, such that a card is claspable between the cover front wall and the base front wall when the base is pivoted about the hinge to close the package, the card being conformed to a curvature approximately matching that of the cover front wall by being clasped between the curved cover front wall and the curved base front wall.

* * * * *